United States Patent [19]

Schips

[11] Patent Number: 5,027,733

[45] Date of Patent: Jul. 2, 1991

[54] SEWING MACHINE WITH AUTOMATIC SEPARATION OF PIECES OF SEWING MATERIAL

[75] Inventor: Helmut Schips, St. Gallen, Switzerland

[73] Assignee: Schips AG Nähautomation, Tuebach, Switzerland

[21] Appl. No.: 352,251

[22] Filed: May 16, 1989

[30] Foreign Application Priority Data

May 17, 1988 [DE] Fed. Rep. of Germany ..... 3816782

[51] Int. Cl.[5] ..... D05B 65/00

[52] U.S. Cl. ..... 112/287; 112/288

[58] Field of Search ..... 112/287, 288, DIG. 1

[56] References Cited

U.S. PATENT DOCUMENTS

| | | | |
|---|---|---|---|
| 3,046,919 | 7/1962 | Fox | 112/288 X |
| 3,143,987 | 8/1964 | Daniel et al. | 112/287 |
| 3,356,054 | 12/1967 | Southwell et al. | 112/287 |
| 3,494,315 | 2/1970 | Washburn | 112/288 X |
| 3,511,202 | 5/1970 | Strauss et al. | 112/287 |
| 3,557,730 | 1/1971 | Armstead, Jr. | 112/287 |
| 3,624,734 | 11/1971 | Schips | 112/287 |
| 3,710,743 | 1/1973 | Lees | 112/252 |
| 4,038,933 | 8/1977 | Marforio | 112/DIG. 1 X |
| 4,149,478 | 4/1979 | Sanvito et al. | 112/288 |
| 4,644,884 | 2/1987 | Tatsumi | 112/288 X |

FOREIGN PATENT DOCUMENTS

| | | |
|---|---|---|
| 1945310 | 9/1969 | Fed. Rep. of Germany . |
| 7247361 | 12/1972 | Fed. Rep. of Germany . |
| 2417325 | 4/1974 | Fed. Rep. of Germany . |
| 2437192 | 8/1974 | Fed. Rep. of Germany . |
| 2803669 | 1/1978 | Fed. Rep. of Germany . |
| 2835994 | 8/1978 | Fed. Rep. of Germany . |
| 3047121 | 12/1980 | Fed. Rep. of Germany . |
| 3522462 | 6/1985 | Fed. Rep. of Germany . |
| 2379635 | 1/1978 | France . |

*Primary Examiner*—Werner H. Schroeder
*Assistant Examiner*—Paul C. Lewis
*Attorney, Agent, or Firm*—Burnes, Doane, Swecker & Mathis

[57] ABSTRACT

A sewing machine capable of automatically severing a thread chain between successive pieces of sewing material includes a cutting device provided behind a sewing needle in a feed direction of the sewing material, a suction device for sucking the thread chain toward the cutting device, and a feeder and a cooperating pressure plate of a presser foot which each have a projection extending in the feed direction such that the cutting device and the ends of the feeder and the presser plate lie substantially in one plane.

1 Claim, 1 Drawing Sheet

SEWING MACHINE WITH AUTOMATIC SEPARATION OF PIECES OF SEWING MATERIAL

BACKGROUND AND SUMMARY OF THE PRESENT INVENTION

The subject of the invention is a sewing machine having a means for automatically severing the thread chain between successive pieces of sewing material, wherein:

(a) a cutting means is provided behind the sewing needle, in the feed direction of the sewing material, and laterally offset from the sewing axis;

(b) a suction means is associated with the cutting means for sucking the thread chain to the side and toward the cutting means;

(c) the feeder and the cooperating pressure plate of the presser foot of the sewing machine each have on their side more removed from the cutting means and the suction means a projection extending in the feed direction of the sewing material to an extent such that the cutting means and the ends of the feeder and of the pressure plate are substantially on one plane.

In known sewing machines equipped with a means for automatically severing the thread chain, each sewn piece of material, after its trailing edge has passed the end of the feeder and of the pressure plate of the presser foot, must be drawn forward to the cutting means. This makes the working surface of the sewing machine free for the next piece of sewing material. While the operator feeds a sewn piece to the cutting means by hand, he or she is prevented from continuing the sewing work proper.

The invention relieves the operator of the time-consuming handling activity described above. This results in a rise of productivity. The sewing machine is technically of very simple construction.

With the inventive sewing machine, each sewn piece of material is moved on without any help from the operator and without the use of any additional conveying means, and the thread chain between successive pieces of sewing material is automatically severed. When the trailing edge of a piece of sewing material has passed through about one third of the length of the feeder and the pressure plate, from the back edge of the latter, the operator can already concentrate on preparing the next piece of sewing material. The completion of the sewing process on the previous piece of sewing material and the passing on of the sewn piece take place automatically without the operator having to pay any special attention or intervene to pass on the sewn piece. It is also possible to convey the piece of sewing material automatically to further processing units after the thread chain has been severed.

The one-sided extensions of the feeder and the pressure plate cause the particular piece of sewing material to move obliquely forward laterally to the cutting means, slackening the thread chain between this piece and the following piece. This consequently facilitates the suction of the thread chain toward the cutting means.

BRIEF DESCRIPTION OF THE DRAWINGS

The invention shall be explained in more detail by way of example with reference to a preferred embodiment according to the drawing, in which.

DETAILED DESCRIPTION

Figure 1:
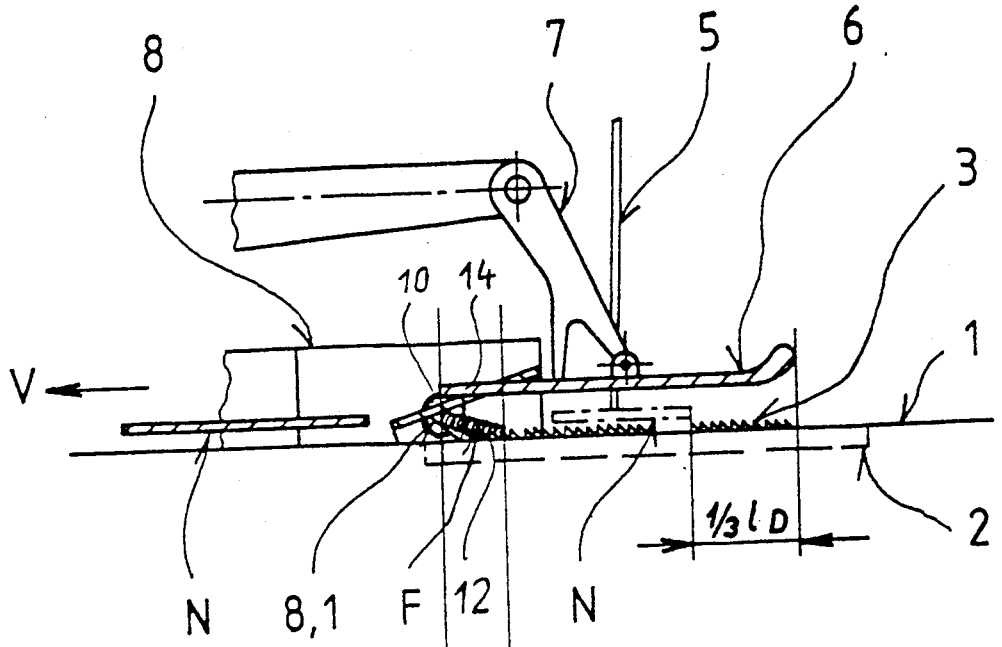
FIG. 1 shows a side wiew of the working surface of a sewing machine together with the inventively designed feeder and pressure plate of the presser foot.
Figure 2:
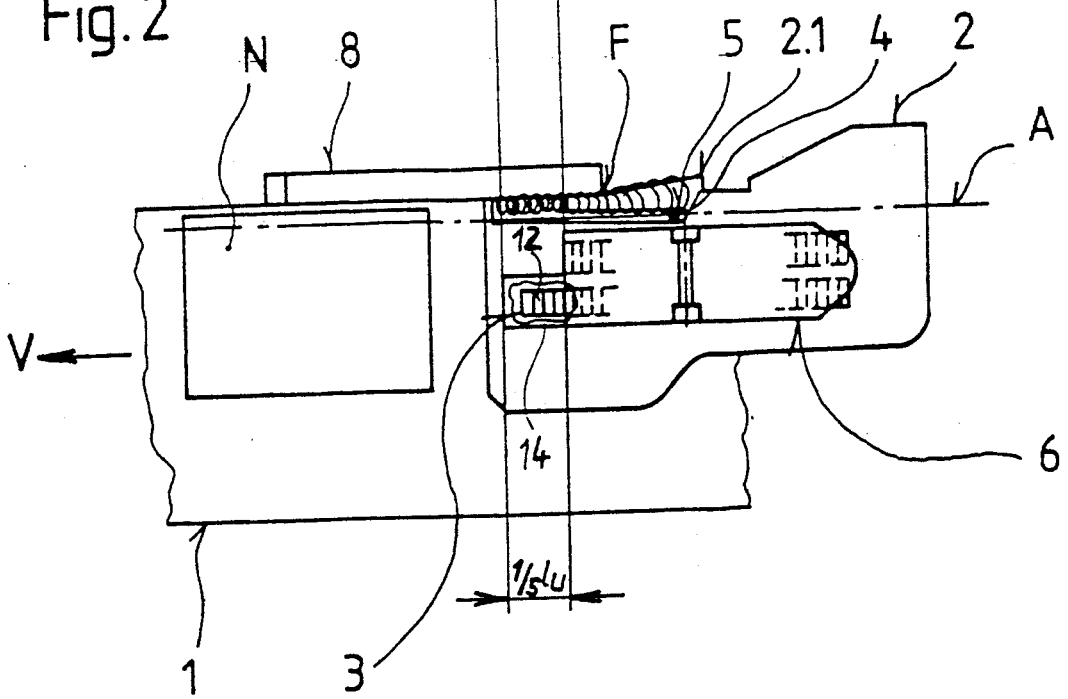
FIG. 2 shows a top view of the working area of the sewing machine as in FIG. 1.

In the working area of the sewing machine as in FIGS. 1 and 2, a needle plate 2 is embedded in working surface 1 thereof . This plate takes up a feeder 3. Further, a wedge-shaped projection 2.1 is formed on the right-hand longitudinal side of needle plate 2, regarded in direction V of the sewing material feed, and pointing in the same direction. The freely extending portion of projection 2.1 separated from needle plate 2 itself by a slit 4 located on sewing axis A, which sewing needle 5 of the sewing machine engages to form the thread formation or thread chain F. FIG. 1 also illustrates above feeder 3 a cooperating pressure plate 6 of a raisable and lowerable presser foot 7 of the sewing machine. Finally, a cutting means 8 with an integrated suction means is disposed parallel to sewing axis A along the right-hand longitudinal side of working surface 1. Suction opening 10 of the suction means is oriented at right angles to feed direction V.

As apparent from FIGS. 1 and 2, feeder 3 and pressure plate 6 each have on their side facing away from cutting means 8 a projection 12, 14 extending downstream in direction V of the sewing material feed as far as the plane of cutting edge 8.1 of cutting means 8, regarded from the operating side of the sewing machine (on the bottom in FIG. 2). The plane of cutting edge 8.1 is located at right angles to feed direction V. Extension 12, 14 is approximately 20% of the hitherto customary overall length $1_u$ of feeder 3/pressure plate 6.

FIGS. 1 and 2 show a sewn and moved on piece N of sewing material directly after severing of thread formation F by cutting edge 8.1 of cutting means 8. Further, the dot-dash outline of the trailing portion of a piece N of sewing material in FIG. 1 represents that position of piece N in the course of the sewing process as of which no more supervision by the operator is required and this person can concentrate on preparing the next piece N. In the shown position of piece N, there is a distance between the trailing edge thereof and the back edge of pressure plate 6 that is about one third of the overall length $1_D$ of pressure plate 6.

I claim:

1. A sewing machine for sewing a seam in successive workpieces fed through said sewing machine and for automatically severing a thread chain between adjacent workpieces, said sewing machine comprising:

a needle for sewing said seam;

a feeder for engaging lower surfaces of said workpieces, said feeder having a first rear end portion located substantially downstream from said needle;

a pressure plate for engaging upper surfaces of said workpieces, said pressure plate having an end of a first rear portion located a substantially equal downstream distance from said needle as an end of said first rear end portion of said feeder;

cutting means for cutting said thread chain, said cutting means being located downstream of said needle and laterally offset from said needle, said cutting means including a cutting edge which is located a substantially equal downstream distance from the needle as the ends of both of said rear end portions;

suction means for sucking said thread into said cutting means; and said feeder and said pressure plate each further including a second rear end portion located downstream of said needle and upstream of said cutting means, said first rear end portions being laterally more remote from said cutting means than said second rear end portions.

* * * * *